US005548862A

United States Patent [19]

Curtis

[11] Patent Number: 5,548,862

[45] Date of Patent: Aug. 27, 1996

[54] CLEANING UTENSIL

[76] Inventor: Sandra Curtis, 1516 Huntington Dr., Glenview, Ill. 60025

[21] Appl. No.: 532,239

[22] Filed: Sep. 22, 1995

[51] Int. Cl.[6] ..... A47L 13/12

[52] U.S. Cl. ..... 15/118; 15/121; 15/244.1; 15/244.3

[58] Field of Search ..... 15/244.1, 244.2, 15/244.3, 229.13, 121, 144.4, 209.1, 210.1, 211, 223, 118; 451/523, 524, 525

[56] References Cited

U.S. PATENT DOCUMENTS

| | | | |
|---|---|---|---|
| D. 280,449 | 9/1985 | Colognori . | |
| 315,814 | 4/1885 | Morgan . | |
| D. 353,940 | 1/1995 | Joyner et al. . | |
| 982,232 | 1/1911 | Bartholomew | 15/244.1 |
| 2,339,547 | 1/1944 | Carter . | |
| 2,885,703 | 5/1959 | Ellliott | 15/244.1 |
| 2,941,225 | 6/1960 | Paul | 15/244.1 |
| 2,960,711 | 11/1960 | Schoenfield et al. | 15/244.1 |
| 2,983,944 | 5/1961 | Uselis | 15/244.1 |
| 3,228,398 | 1/1966 | Leonard et al. | 15/244.1 |
| 3,262,459 | 7/1966 | Sheehan | 15/244.1 |
| 3,319,281 | 5/1967 | Montgomery | 15/244.1 |
| 3,491,397 | 1/1970 | Hesener | 15/244,2 |
| 3,785,000 | 1/1974 | Zacha et al. . | |
| 3,798,700 | 3/1974 | Popeil | 15/244.2 |
| 3,818,911 | 6/1974 | Fournier | 15/244.2 |
| 3,857,133 | 12/1974 | Linenfelser . | |
| 4,099,289 | 7/1978 | Bretthauer . | |
| 4,135,274 | 1/1979 | Freeman | 15/244.1 |
| 4,315,342 | 2/1982 | Ash | 15/244.1 |
| 4,409,700 | 10/1983 | Sullivan | 15/121 |
| 4,475,836 | 10/1984 | Colognori . | |
| 5,033,155 | 7/1991 | Klotz | 15/244.3 |
| 5,052,840 | 10/1991 | St. Cyer . | |
| 5,214,820 | 1/1993 | Shumway et al. | 15/244.1 |
| 5,336,330 | 8/1994 | Shumway et al. . | |
| 5,408,718 | 4/1995 | Sadovsky . | |
| 5,435,040 | 7/1995 | McClure | 15/244.1 |

FOREIGN PATENT DOCUMENTS

| | | | |
|---|---|---|---|
| 18361 | of 1900 | United Kingdom | 15/244.1 |

*Primary Examiner*—Frankie L. Stinson
*Assistant Examiner*—Tony G. Soohoo
*Attorney, Agent, or Firm*—Welsh & Katz, Ltd.

[57] ABSTRACT

A cleaning utensil includes an elongated handle having proximal and distal ends and a substantially spherical sponge having a cavity for fixedly receiving and retaining the distal portion of the elongated handle. The sponge is formed from material having a first predetermined softness and at least one abrasive scouring element is fixedly attached to a portion of the surface of the spherical sponge. The at least one abrasive scouring element is formed from material having a second predetermined softness where the second predetermined softness is greater in abrasiveness than the first predetermined softness to facilitate cleaning of lightly and heavily soiled areas, respectively.

20 Claims, 1 Drawing Sheet

CLEANING UTENSIL

BACKGROUND OF THE INVENTION

The present invention relates generally to a cleaning utensil and more specifically to an improved cleaning utensil having a spherical sponge with an elongated handle and scouring strips affixed to the surface of the sponge.

Devices used for cleaning vary widely in their construction, utility and cost. For example, known mops often include a combination of a rectangular pivoting sponge attached to handles of various lengths. However, such known mops are difficult and inconvenient to use in cramped spaces and do not easily clean heavily soiled areas.

Known scouring pads are also available in the form of rectangular abrasive pads or bristle scrub brushes. However, use of these devices requires the user to assume generally difficult and tiresome body positions, such as bending and being on hands and knees.

A variety of known sponges having differing abrasive qualities are used to perform various cleaning tasks. In an effort to overcome the inconvenience of using two different sponges, dual sponges or pads have permanently combined two types of materials in a single pad. A common feature of such known dual pads is that the two materials comprising the pad are connected to each other in a way such that when the pad is used, the hand of the user must ordinarily come into contact with both materials. Such contact is normally undesirable since one of the two materials is typically abrasive and uncomfortable to the touch.

Accordingly, it is an object of the present invention to substantially overcome the above-described problems.

It is another object of the present invention to provide an improved cleaning utensil that is easily used to clean bathtubs, toilets, sinks and the like.

It is a further object of the present invention to provide an improved cleaning utensil that provides both a soft sponge surface in combination with an abrasive scouring surface.

It is also an object of the present invention to provide an improved cleaning utensil having an elongated handle so that the user does not contact the sponge portion.

It is still an object of the present invention to provide an improved cleaning utensil which includes a flat squeegee attachment affixed to an end of the handle.

SUMMARY OF THE INVENTION

The disadvantages of cleaning utensils are substantially overcome with the present invention by providing an improved cleaning utensil having a soft relatively non-abrasive sponge portion having an abrasive scouring portion attached. The sponge is attached to a handle which may be telescopically constructed to adjust in length depending upon the task at hand. Since the sponge combines a relatively non-abrasive sponge portion and an abrasive scouring portion, the utensil can be used to clean delicate objects, such as expensive porcelain sinks and heavily soiled objects, such as bathtubs and toilets.

For enhanced flexibility, a squeegee device is attached to the end of the handle and may be rotated perpendicular to the handle when in use. The squeegee can be used to clean and wipe shower doors, windows and mirrors. Thus, a universal cleaning utensil for bathrooms or kitchens is provided.

More specifically, the improved cleaning utensil of the present invention includes an elongated handle having proximal and distal ends and a substantially spherical sponge having a cavity for fixedly receiving the distal portion of the elongated handle. The sponge is formed from material having a first predetermined softness and at least one abrasive scouring element is fixedly attached to a portion of the surface of the spherical sponge. The at least one abrasive scouring element is formed from material having a second predetermined softness where the second predetermined softness is greater in abrasiveness than the first predetermined softness to facilitate cleaning of lightly and heavily soiled areas, respectively.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

FIGS. 3–5 are perspective views of a specific embodiment of an improved cleaning utensil showing attachment of a sponge to a handle.

DETAILED DESCRIPTION OF THE INVENTION

Figure 1:
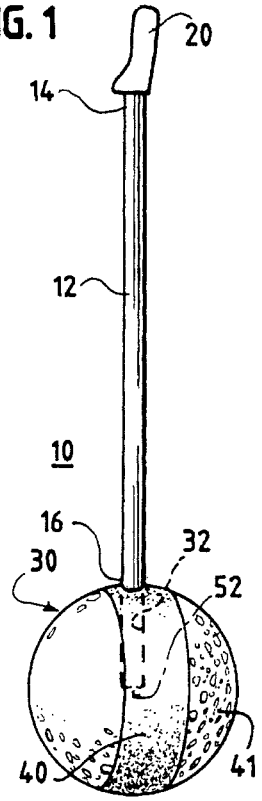
FIGS. 1–3 are perspective views of a specific embodiment of an improved cleaning utensil according to the present invention.
Figure 2:
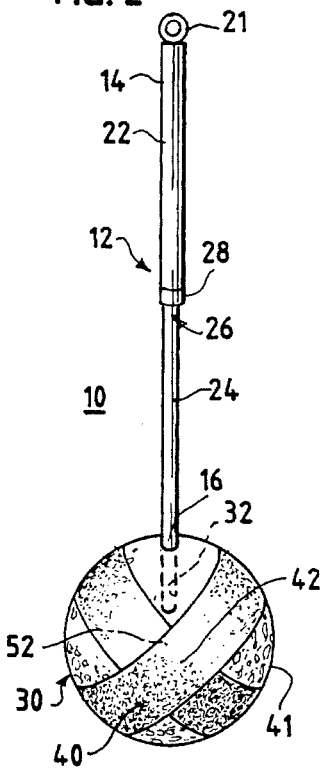
Figure 3:
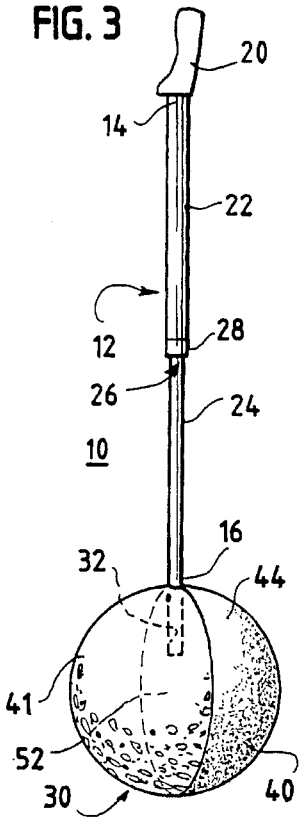

Referring now to FIGS. 1–3, a cleaning utensil 10 is shown generally. The utensil 10 includes a handle 12 elongated in a longitudinal direction having proximal 14 and distal 16 ends. The handle 12 may be constructed from a wood dowel, plastic rod, fiberglass tubing, metal tubing or any other suitable material. A grip portion 20 may be attached to the proximal end 14 of the handle 12 to provide a convenient and ergonomically correct hand grip for the user. The grip portion 20 is also used so that the user can easily apply force to the handle 12 without suffering hand fatigue. The grip portion 20 may be omitted and a circular hanger portion 21 added instead, as shown in FIG. 2. The hanger portion 21 is used to conveniently hang the utensil 10 on a hook or nail. The handle 12 is preferably forty-five inches in length but may be, for example, five to sixty inches in length, depending upon the cleaning application. The diameter of the handle 12 is preferably ¾ inches but may be, for example, ¼ to 1 inch in diameter.

Alternatively, the handle 12 may include multiple sections which telescopically extend and retract relative to each other, as illustrated in FIGS. 2–5. This allows the user to conveniently clean areas normally out of reach, such at toward the top of a shower stall. The handle 12 includes a first elongated portion 22 and a second elongated portion 24 telescopically mounted to the first elongated portion. The first elongated portion 22 is substantially hollow having a throughbore 26 with an inside diameter about equal to the outside diameter of the second elongated portion 24 to facilitate telescopic attachment.

A friction ring or tightening ring 28 disposed around the outside peripheral surface of the handle 12 at the intersection of the first 22 and second 24 elongated sections may be used to lock the two handle portions together, as is known in the art. The friction ring 28 is threaded and mates with corresponding threads on the first elongated portion 22. When the friction ring 28 is rotated or tightened, the first elongated portion 22 is slightly compressed in the area under the friction ring causing the first elongated portion to frictionally engage the second elongated portion 24 along the throughbore 26. This essentially locks the portions 22 and 24 of the elongated handle together so that the user can apply force to the utensil 10 without collapsing the handle 12 to facilitate heavy scrubbing.

Use of the elongated handle 12 allows the user to avoid difficult physical positions when cleaning, such as bending and being on hands and knees. The elongated handle 12 also permits the user to reach substantially all portions of the area to be cleaned, such as ends of a bathtub and distant portions of a tall shower stall.

A substantially spherical sponge 30 is secured to the distal end 16 of the handle 12. The sponge 30 material may be formed of conventional foam plastic, the stiffness and density of which is selected to suit. The sponge 30 material may also be natural or artificial material. The sponge 30 includes a cavity 32 radially disposed within the body of the sponge for fixedly receiving the distal portion 16 of the elongated handle 12. The handle 12 is retained within the cavity 32 using a suitable chemical adhesive, as is known in the art. Alternatively, the dimensions of the cavity 32 may be appropriately sized to accommodate the handle 12 with a frictional interference fit such that no chemical adhesive is required. If no chemical adhesive is used, the sponge 30 may be removed from the handle 12 and replaced by the user as required. The sponge 30 is preferably twelve inches in diameter, but may be, for example in the range of between about eight to sixteen inches, depending upon the cleaning task.

The sponge 30 includes at least one abrasive scouring element 40 fixedly attached to a portion of a surface 41 of the sponge. The abrasive scouring element 40, for example, may be formed from fabric, steel wool, synthetic plastic strands or combinations of abrasive material or foam, or any other suitable material.

As particularly shown in FIG. 1, the scouring element 40 is a linear strip of scouring material affixed about the surface 41 of the spherical sponge 30. Preferably, the strip of scouring material 40 circumscribes a diameter of the sponge 30 and passes through the point where the handle 12 passes through the surface 41 of the sponge. In this configuration, an aperture (not shown) in the scouring strip allows the handle 12 to pass therethrough and further aids to secure the scouring strip 40 to the sponge. However, the strip of scouring material 40 need not circumscribe the diameter of the sponge 30 and may disposed on the surface 41 of the sponge 30 along any geometric path.

If the strip of scouring material 40 circumscribes the diameter of the sponge 30 and passes through the point where the handle 12 passes through the surface 41 of the sponge, the user may aggressively use the utensil 10 to clean heavily soiled areas, since force applied to the handle 12 causes the sponge 12 to compress and deform toward the handle. If the scouring strip 40 is oriented in the proper direction, that is, oriented so that the plane formed by the "ring" of the scouring strip is normal to the surface being cleaned, the force applied to the handle and to the compressed portion of the sponge is essentially transferred to the scouring strip such that heavy pressure is applied to the scouring strip to facilitate cleaning of heavily soiled areas.

Preferably, the strip of scouring material 40 is about equal in width to 30% of the diameter of the sponge 30 and may range from about between 20%–40% of the diameter of the sponge. Thus, for example, for a twelve inch diameter sponge 30, the strip of scouring material 40 is about four inches wide.

Alternatively, as shown in FIG. 2, the abrasive scouring element 40 may include two or more linear strips of scouring material affixed about the surface 41 or about the circumference of the spherical sponge 30. If two or more scouring strips 40 are used, the strips intersect each other at at least two points 42, only one of which is shown in FIG. 2. One of the intersections 42 of the scouring strips 40 is oriented on the surface 41 of the sponge at point meeting an imaginary axial projection of the handle so that when the utensil 10 is used to aggressively clean heavily soiled areas, as described above, the intersection or "X-shaped" pattern formed by the strips is applied or scrubbed under pressure against the soiled area.

Alternatively, as shown in FIG. 3, the abrasive scouring element 40 may be affixed over a continuous portion of the spherical sponge 30, such as over a hemispherical portion 44 of the spherical sponge. Thus, approximately one-half of the surface of the sponge 30 can be used to clean lightly soiled areas and the other half of the sponge can be used to clean heavily soiled areas.

The abrasive scouring elements 40, whether in the form of one or more strips (FIGS. 1–2) or in the form of a hemispherical portion (FIG. 3), are affixed or bonded to the surface 41 of the sponge 30, for example, by means of a suitable chemical adhesive. Alternatively, the abrasive scouring elements 40 may be affixed or thermally bonded to the sponge 30 using heat sealing methods, as is well known in the art, or may be stitched to the sponge using natural or synthetic thread.

The scouring elements 40 attached to the surface 41 of the sponge 30 provide significant advantages and permit the utensil 10 to be used for multiple purposes. The sponge 30 is formed from material having a first predetermined abrasiveness while the abrasive scouring elements 40 are formed from material having a second predetermined abrasiveness, where the second predetermined abrasiveness is significantly more abrasive than the first predetermined abrasiveness. This facilitates cleaning of lightly and heavily soiled areas merely by adjusting the orientation of the utensil 10 relative to the surface to be cleaned.

Abrasive material can scratch and possible damage delicate materials. Accordingly, the user orients the utensil 10 so that the abrasive scouring elements 40 do not contact the delicate areas to be cleaned while only the sponge 30 portion makes contacts. This insures proper cleaning of lightly soiled or delicate areas. In contrast, abrasive material may be needed to clean heavily soiled areas. Accordingly, the user orients the utensil 10 so that the abrasive scouring elements 40 contact the area to be cleaned. Additionally, abrasive scouring powder or commercially available cleaners may be applied to the area to be cleaned.

Figure 4:
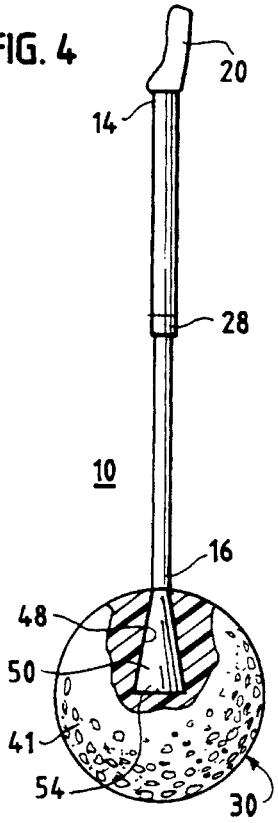
Figure 5:
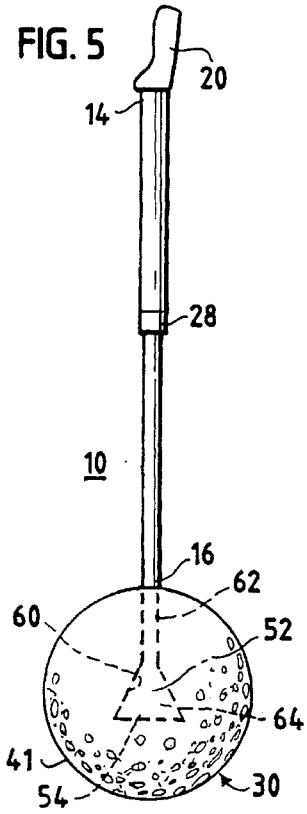

Referring now to FIGS. 4–5, The cavity 30 which receives the elongated handle 12 may have a cylindrical shape, a conical shape, or a combination of cylindrical and conical shapes. As illustrated in FIG. 4, a conically shaped cavity 48 is configured to fixedly retain a corresponding conically shaped portion 50 of the distal end 16 of the elongated handle 12. The conically shaped cavity 48 diverges or has a reverse taper in a direction from the surface 41 of the sponge 30 toward a center 52 of the sponge. Such a geometry aids in securing and retaining the sponge 30 on the handle 12. A wide portion 54 of the conically shaped portion 50 of the elongated handle 12 also aids in the cleaning process by providing a relatively broad surface against which the sponge 30 is compressed when the utensil 10 is disposed against the surface to be cleaned. Again, the handle 12 is retained within the conically shaped cavity 48 using a suitable chemical adhesive, as is known in the art.

Alternatively, as illustrated in FIG. 5, a combination of a conically shaped cavity 60 and a cylindrically shaped cavity 62 is configured to fixedly retain a correspondingly shaped portion 64 of the distal end 16 of the elongated handle 12. The cylindrically shaped portion 62 has the conically shaped portion 60 extending therefrom where the cylindrically shaped portion is disposed toward the surface 41 of the sponge 30 and the conically shaped portion is disposed toward the center 52 of the sponge. However, it may be appreciated that any suitably shaped cavity 32 and correspondingly shaped distal end 16 of the handle 12 may be used to secure the sponge 30 to the distal end. For example, a grooved configuration, a ribbed configuration, a wave-like configuration, a barbed configuration or any suitable configuration may be used to secure the sponge 30 to the distal end 16.

Figure 6:
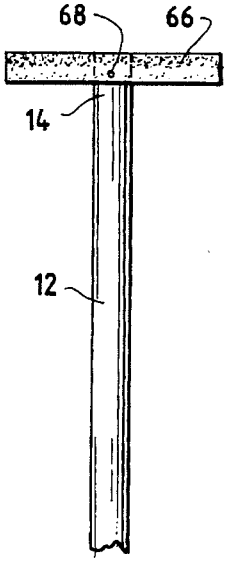
FIGS. 6–7 are perspective views of a specific embodiment of an improved cleaning utensil showing a squeegee attachment.
Figure 7:
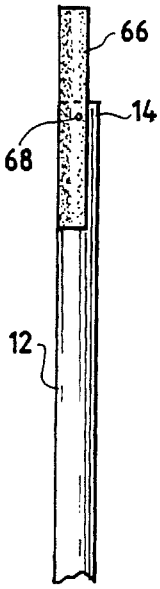

Referring now to FIGS. 6–7, a substantially flat wiping element 66 may be pivotally mounted to the proximal end 14 of the elongated handle 12 and is attached in place of the hand grip portion 20 (FIGS. 1–5). The wiping element 66 may be, for example, a conventional squeegee device used for wiping and cleaning planar surfaces, such as mirrors, windows and shower stall doors, as is known in the art. The wiping element 66 may be formed from plastic or rubber or other suitable material. The wiping element 66 is configured to frictionally rotate relative to the elongated handle 12 and is affixed to the handle by means of a rivet 68, a screw, a bolt and the like. The wiping element 66 is configured to rotate under hand pressure and is arranged to remain in the rotated position under a frictional fit created between the wiping element and the handle 12.

When in use, the wiping element 66 is rotated to an orientation substantially perpendicular to the handle 12 to facilitate cleaning and wiping of planar surfaces, as illustrated in FIG. 6. When not in use, the wiping element 66 is rotated to an orientation parallel to the handle 12, as illustrated in FIG. 7.

A specific embodiment of an improved cleaning utensil according to the present invention has been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A cleaning utensil comprising:

an elongated handle having proximal and distal ends;

a substantially spherical sponge having a cavity for fixedly receiving and retaining the distal portion of the elongated handle;

said sponge being of a first predetermined level of abrasiveness;

at least one abrasive scouring element fixedly attached to a portion of a surface of the spherical sponge;

said at least one abrasive scouring element being of a second predetermined level of abrasiveness;

said second predetermined level of abrasiveness being greater than said first predetermined level of abrasiveness to facilitate cleaning of lightly and heavily soiled areas, respectively; and said at least one abrasive scouring element including a linear strip of scouring material affixed about the surface of the spherical sponge.

2. The utensil of claim 1 wherein the at least one abrasive scouring element is thermally bonded to the surface of the spherical sponge.

3. The utensil of claim 1 wherein the at least one abrasive scouring element is bonded to the surface of the spherical sponge with a chemical adhesive.

4. The utensil of claim 1 wherein the at least one abrasive scouring element is stitched to the surface of the spherical sponge.

5. The utensil of claim 1 wherein the cavity is cylindrical in shape and configured to fixedly receive and retain a cylindrical portion of the distal end of the elongated handle.

6. The utensil of claim 5 wherein the cylindrical portion of the elongated handle is retained within the cavity with a chemical adhesive.

7. The utensil of claim 1 wherein the cavity is conically shaped and configured to fixedly receive and retain a conically shaped portion of the distal end of the elongated handle, said conically shaped cavity diverging in a direction from a surface of the sponge towards a center of the sponge.

8. The utensil of claim 7 wherein the conically shaped portion of the elongated handle is retained within the cavity with a chemical adhesive.

9. The utensil of claim 1 wherein the cavity is integrally formed from a cylindrically shaped portion and a conically shaped portion extending from said cylindrically shaped portion, said cylindrically shaped portion disposed toward a surface of the sponge and said conically shaped portion inwardly disposed toward a center of the sponge, said cavity configured to fixedly receive and retain the elongated handle, said elongated handle having corresponding cylindrical and conically shaped portions.

10. The utensil of claim 9 wherein the cylindrically shaped portion and the conically shaped portion of the elongated handle are retained within the cavity with a chemical adhesive.

11. The utensil of claim 1 wherein the elongated handle further includes a first elongated portion and a second elongated portion, said first and second portions configured to telescopically extend and retract relative to each other.

12. A cleaning utensil comprising:

an elongated handle having proximal and distal ends;

a substantially spherical sponge having a cavity for fixedly receiving and retaining the distal portion of the elongated handle;

said sponge being of a first predetermined level of abrasiveness;

at least one abrasive scouring element fixedly attached to a portion of a surface of the spherical sponge;

said at least one abrasive scouring element being of a second predetermined level of abrasiveness;

said second predetermined level of abrasiveness being greater than said first predetermined level of abrasiveness to facilitate cleaning of lightly and heavily soiled areas, respectively; and said at least one abrasive scouring element including two or more linear strips of scouring material affixed about a circumference of the spherical sponge, said linear strips intersecting each other at least two points.

13. The utensil of claim 12 wherein the at least one abrasive scouring element is thermally bonded to the surface of the spherical sponge.

14. The utensil of claim 12 wherein the at least one abrasive scouring element is bonded to the surface of the spherical sponge with a chemical adhesive.

15. The utensil of claim 12 wherein the cavity is cylindrical in shape and configured to fixedly receive and retain a cylindrical portion of the distal end of the elongated handle.

16. A cleaning utensil comprising:

an elongated handle having proximal and distal ends;

a substantially spherical sponge having a cavity for fixedly receiving and retaining the distal portion of the elongated handle;

said sponge being of a first predetermined level of abrasiveness;

at least one abrasive scouring element fixedly attached to a portion of a surface of the spherical sponge;

said at least one abrasive scouring element being of a second predetermined level of abrasiveness;

said second predetermined level of abrasiveness being greater than said first predetermined level of abrasiveness to facilitate cleaning of lightly and heavily soiled areas, respectively; and said at least one abrasive scouring element including scouring material affixed over a continuous hemispherical portion of the spherical sponge.

17. The utensil of claim 16 wherein the at least one abrasive scouring element is thermally bonded to the surface of the spherical sponge.

18. The utensil of claim 16 wherein the at least one abrasive scouring element is bonded to the surface of the spherical sponge with a chemical adhesive.

19. The utensil of claim 16 wherein the cavity is cylindrical in shape and configured to fixedly receive and retain a cylindrical portion of the distal end of the elongated handle.

20. A cleaning utensil comprising:

an elongated handle having proximal and distal ends;

a substantially spherical sponge having a cavity for fixedly receiving and retaining the distal portion of the elongated handle;

said sponge being of a first predetermined level of abrasiveness;

at least one abrasive scouring element fixedly attached to a portion of a surface of the spherical sponge;

said at least one abrasive scouring element being of a second predetermined level of abrasiveness;

said second predetermined level of abrasiveness being greater than said first predetermined level of abrasiveness to facilitate cleaning of lightly and heavily soiled areas, respectively; and a substantially flat wiping element pivotally mounted to the proximal end of the elongated handle, said wiping element configured to frictionally rotate relative to the elongated handle under hand pressure, said wiping element adapted to reciprocally rotate from an orientation parallel to the handle to an orientation substantially perpendicular to the handle to facilitate cleaning and wiping of planar surfaces.

* * * * *